US010401106B1

(12) United States Patent
McMurray

(10) Patent No.: US 10,401,106 B1
(45) Date of Patent: Sep. 3, 2019

(54) QUICK RELEASE STORAGE AND LOCKING SYSTEMS AND METHODS OF USE THEREOF

(71) Applicant: William McMurray, Detroit, MI (US)

(72) Inventor: William McMurray, Detroit, MI (US)

( * ) Notice: Subject to any disclaimer, the term of this patent is extended or adjusted under 35 U.S.C. 154(b) by 0 days.

(21) Appl. No.: 16/015,248

(22) Filed: Jun. 22, 2018

(51) Int. Cl.
*F41A 17/06* (2006.01)
*F41A 17/02* (2006.01)

(52) U.S. Cl.
CPC ..... *F41A 17/06* (2013.01); *F41A 17/02* (2013.01)

(58) Field of Classification Search
CPC ..... F41C 27/00
See application file for complete search history.

(56) References Cited

U.S. PATENT DOCUMENTS 5,392,552 A * 2/1995 McCarthy ..... F41A 17/54 42/70.06
5,417,000 A * 5/1995 Chen ..... F41A 17/02 42/70.06
5,419,068 A * 5/1995 Pages ..... F41A 17/54 42/70.07
5,561,935 A * 10/1996 McCarthy ..... F41A 17/54 42/70.07
5,638,627 A * 6/1997 Klein ..... F41A 17/04 42/70.06
5,918,402 A * 7/1999 Weinraub ..... F41A 17/54 42/70.07
6,205,695 B1 * 3/2001 Schnell ..... F41A 17/54 42/70.07
6,408,555 B1 * 6/2002 Sapia ..... F41A 17/06 42/70.07
7,281,397 B2 * 10/2007 Victor ..... E05B 73/00 42/70.01
8,893,420 B2 * 11/2014 Milde, Jr. ..... F41A 35/00 42/70.06
9,010,007 B2 * 4/2015 Chandler ..... F41A 17/04 206/315.11
9,097,479 B1 * 8/2015 Barido ..... F41A 17/066
9,404,699 B1 * 8/2016 Barido ..... F41A 17/54
9,970,725 B2 * 5/2018 Kiyani ..... F41A 17/063
2006/0117633 A1 * 6/2006 Chang ..... F41A 17/02 42/70.07
2008/0134556 A1 * 6/2008 Remelin ..... F41A 17/066 42/70.07
2013/0312306 A1 * 11/2013 Ruffin ..... F41A 17/066 42/70.07

(Continued)

*Primary Examiner* — Benjamin P Lee
(74) *Attorney, Agent, or Firm* — Burris Law, PLLC

(57) ABSTRACT

A quick release storage and locking system with a base, an electric lock, an L-shaped locking bar and a locking post is provided. The L-shaped locking bar comprises a first end movably attached to the base and a second end with a manual lock spaced apart from the first end. The locking post comprises a first locking end and a second locking end spaced apart from the first locking end. The electric lock is configured to engage the first locking end of the locking post such that the locking post is securely attached to the base and the manual lock is configured to engage the second locking end of the locking post such that the locking post is securely attached to the L-shaped locking bar. In some embodiments, the electric lock may be wirelessly activated. In the alternative or in addition to, the electric lock may be keypad activated.

18 Claims, 10 Drawing Sheets

(56) References Cited

U.S. PATENT DOCUMENTS

Figure 1:
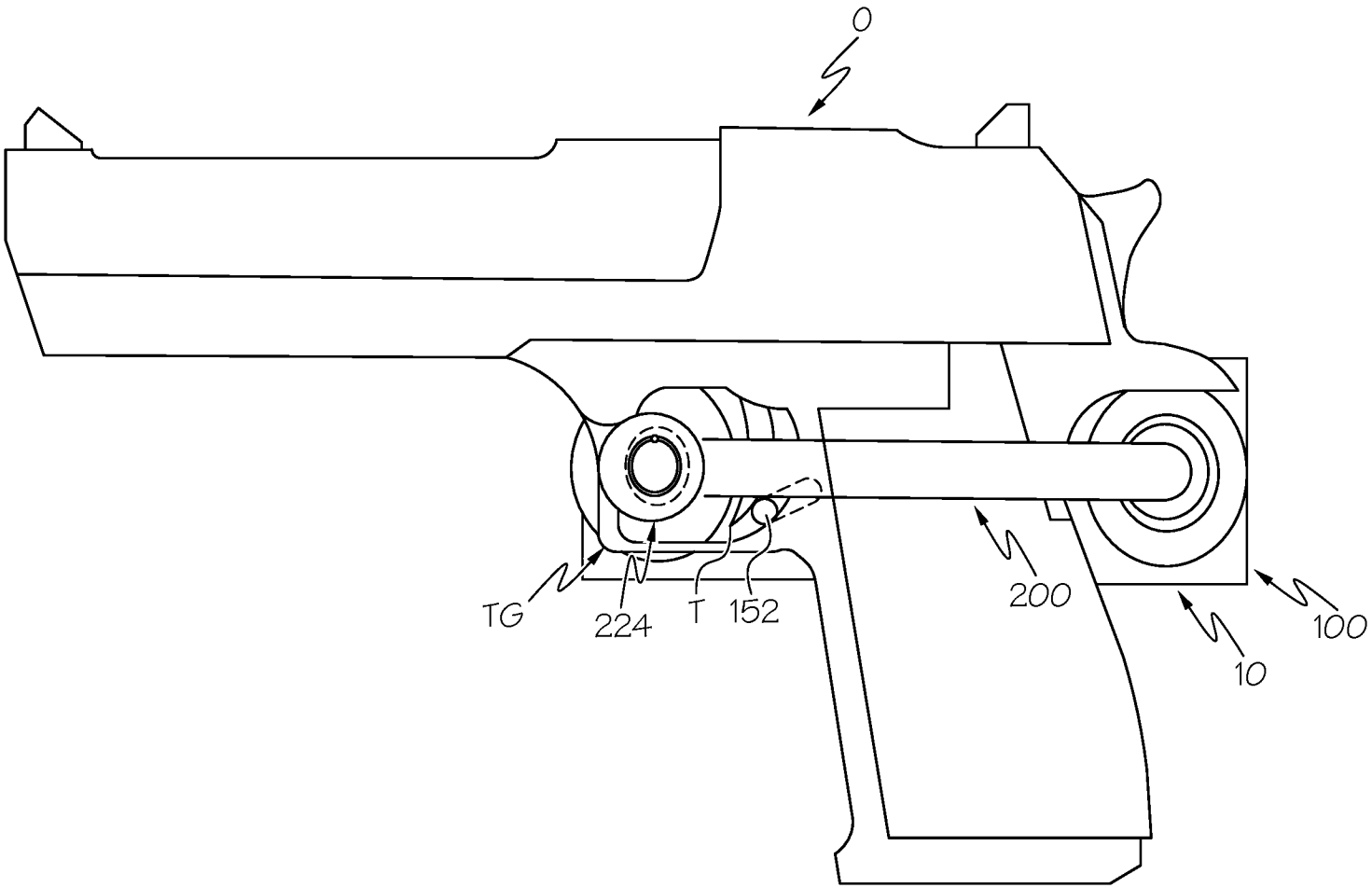

| | | | | |
|---|---|---|---|---|
| 2015/0198402 | A1* | 7/2015 | Brace | F41A 17/54<br>42/70.06 |
| 2016/0377362 | A1* | 12/2016 | Farr | F41A 17/04<br>42/70.06 |

* cited by examiner

QUICK RELEASE STORAGE AND LOCKING SYSTEMS AND METHODS OF USE THEREOF

FIELD

The present disclosure relates to apparatuses and methods for storing, locking and quickly releasing objects and, more specifically, to apparatuses and methods for storing, locking and quickly releasing objects with triggers and trigger guards.

BACKGROUND

The statements in this section merely provide background information related to the present disclosure and may not constitute prior art.

Safekeeping of firearms is an issue of considerable importance to every gun owner. Generally, it is not enough to simply "lock up" a firearm and additional precautions should be taken to ensure a firearm cannot be discharged even it is locked away in a secure cabinet or display case. Also, quick unlocking of the firearm may be desired, even if a key used to lock up the firearm is not available.

Accordingly, a need exists for alternative quick release storage and locking systems for firearms.

SUMMARY

In one embodiment, a quick release storage and locking system includes a base with an electric lock, an L-shaped locking bar and a locking post. The L-shaped locking bar comprises a first end movably attached to the base and a second end with a manual lock spaced apart from the first end. The locking post comprises a first locking end and a second locking end spaced apart from the first locking end. The electric lock is configured to engage the first locking end of the locking post such that the locking post is securely attached to the base and the manual lock is configured to engage the second locking end of the locking post such that the locking post is securely attached to the L-shaped locking bar. In some embodiments, the electric lock may be activated via wireless communication. In the alternative or in addition to, the electric lock may be activated with a keypad. The manual lock may be activated with a physical key. The electric lock may include a microcontroller, a solenoid and a locking pin. The base may comprise an electric lock cavity and the electric lock may be at least partially disposed in the electric lock cavity. Also, a face plate may extend over the electric lock cavity and a trigger post may be attached to and extend from the face plate.

In some embodiments, the quick release storage and locking system comprises a locked position, a first unlocked position, and a second unlocked position different than the first unlocked position. In such embodiments, the locked position may comprise the locking pin of the electric lock engaged with the first locking end of the locking post and the manual lock engaged with the second locking end of the locking post. The first unlocked position may comprise the locking pin of the electric lock engaged with the first locking end of the locking post and the manual lock disengaged with the second locking end of the locking post. The second unlocked position may comprise the locking pin of the electric lock disengaged with the first locking end of the locking post and the manual lock engaged with the second locking end of the locking post.

In another embodiment, a method for storing, locking and quickly releasing a firearm comprises positioning a firearm with a trigger and trigger guard on a quick release storage and locking system. The quick release storage and locking system comprises a base with an electric lock, an L-shaped locking bar with a first end movably attached to the base and a second end with a manual lock, and a locking post with a first locking end and a second locking end spaced apart from the first locking end. The firearm is positioned between the base and the L-shaped locking bar with the locking post extending through the trigger guard. The firearm is secured to the base by locking the first locking end of the locking post to the base via the electric lock and locking the second end of the locking post to the L-shaped locking bar via the manual lock. The firearm is quickly released from the base by disengaging the electric lock from the first locking end of the locking post and/or disengaging the manual lock from the second locking end of the locking position. In some embodiments, the electric lock is disengaged from the first locking end of the locking post via a wireless signal from a personal electronic device. In other embodiments, the electric lock is disengaged from the first locking end of the locking post via a keypad signal.

These and additional features provided by the embodiments described herein will be more fully understood in view of the following detailed description in conjunction with the drawings.

Further areas of applicability will become apparent from the description provided herein. It should be understood that the description and specific examples are intended for purposes of illustration only and are not intended to limit the scope of the present disclosure.

DRAWINGS

Figure 2:
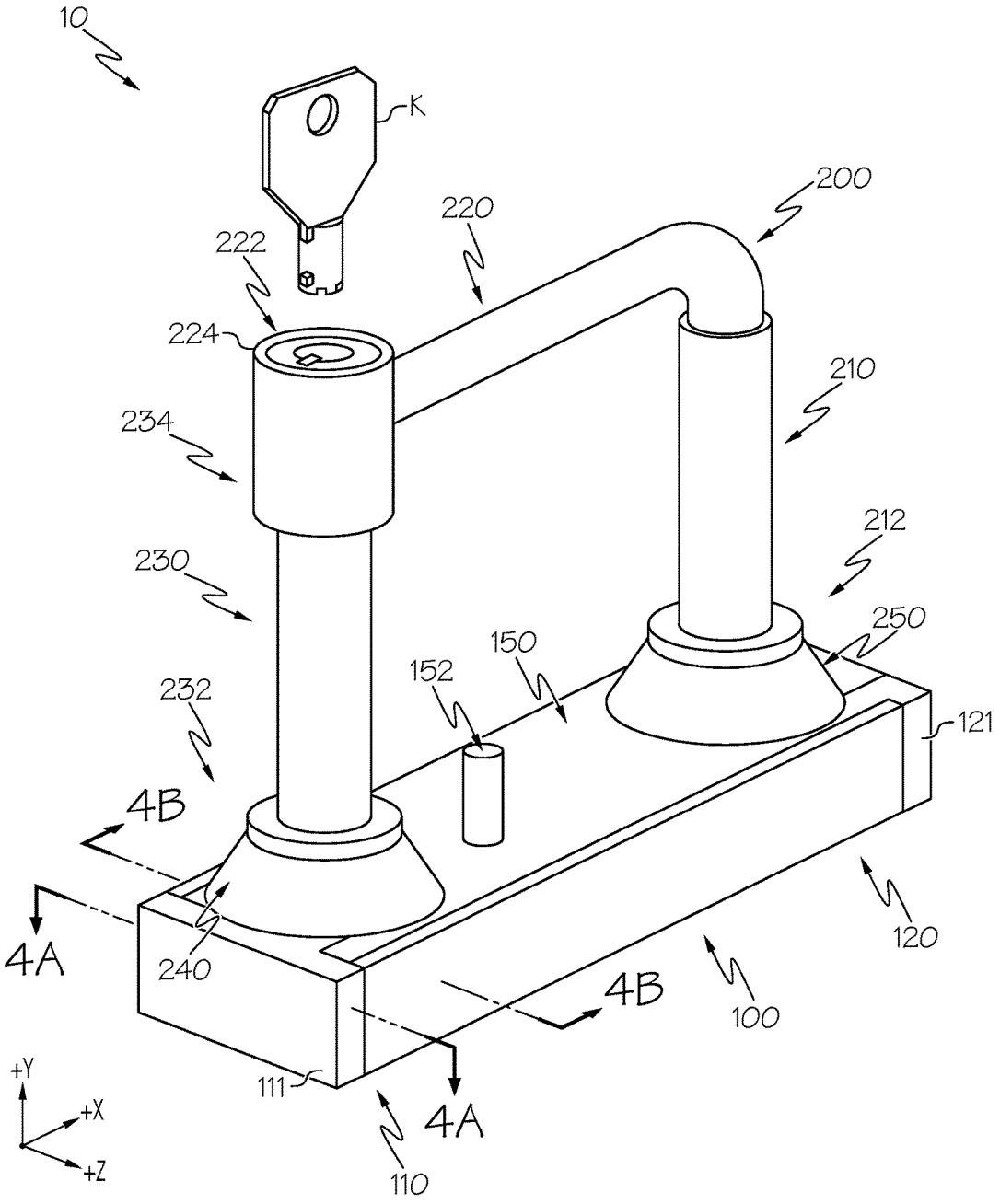
Figure 3:
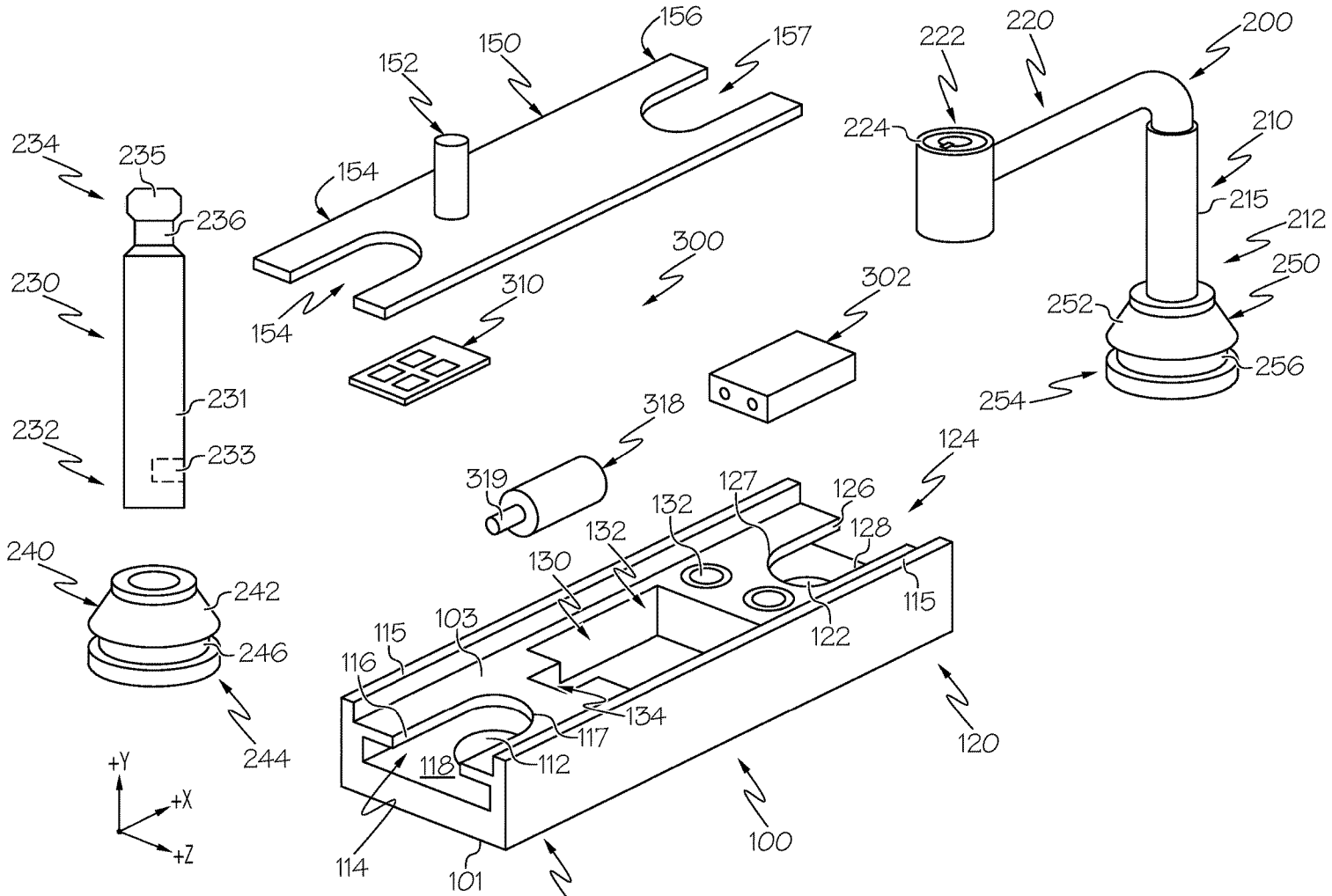
Figure 4A:
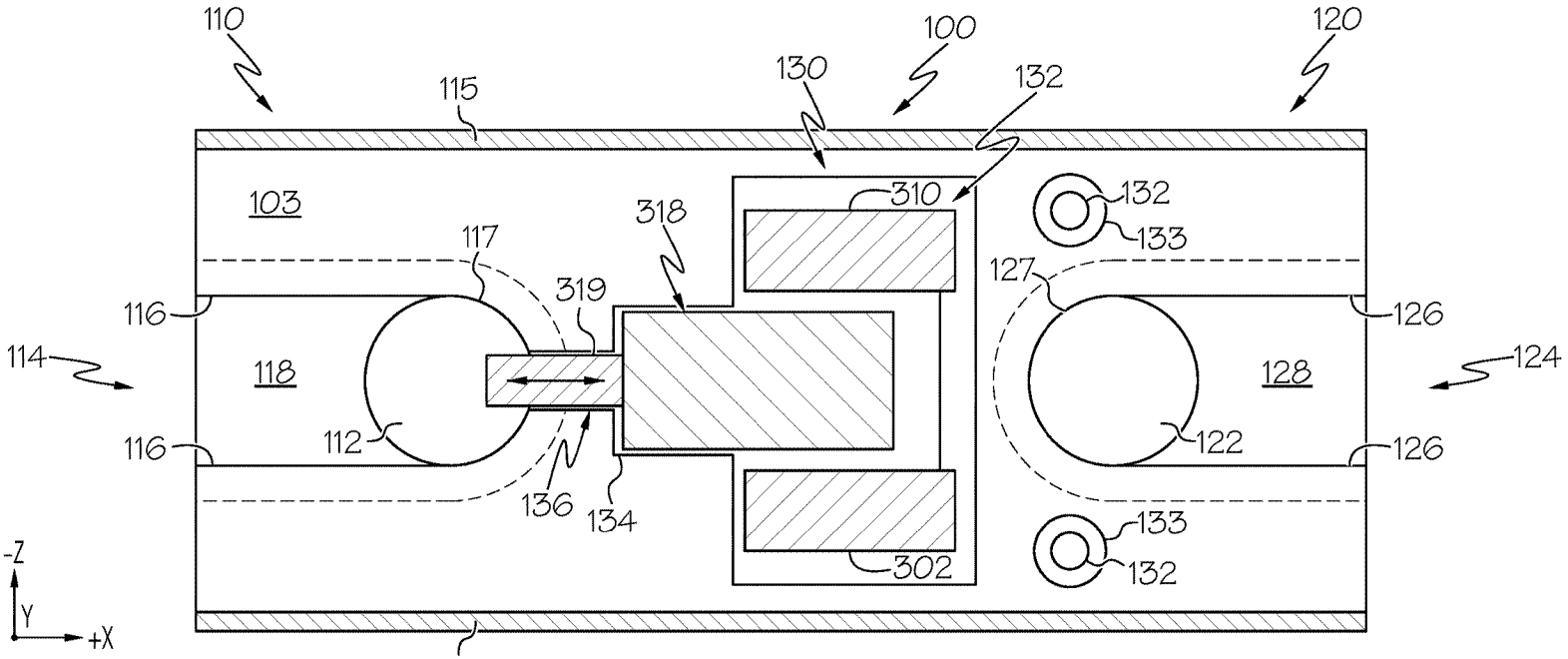
Figure 4B:
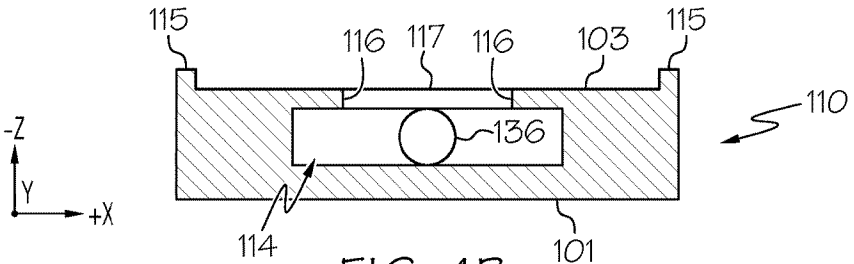
Figure 5:
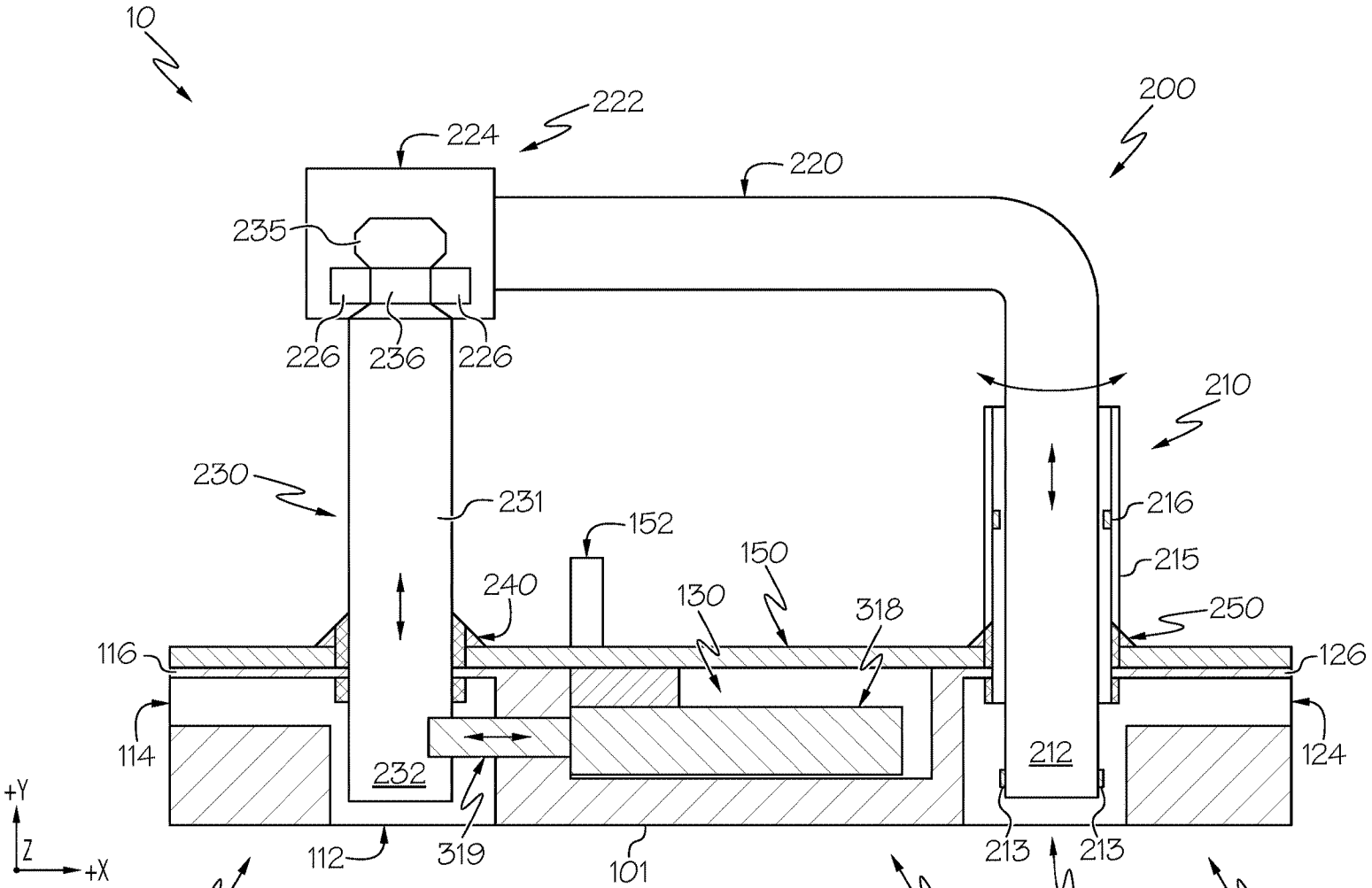
Figure 6:
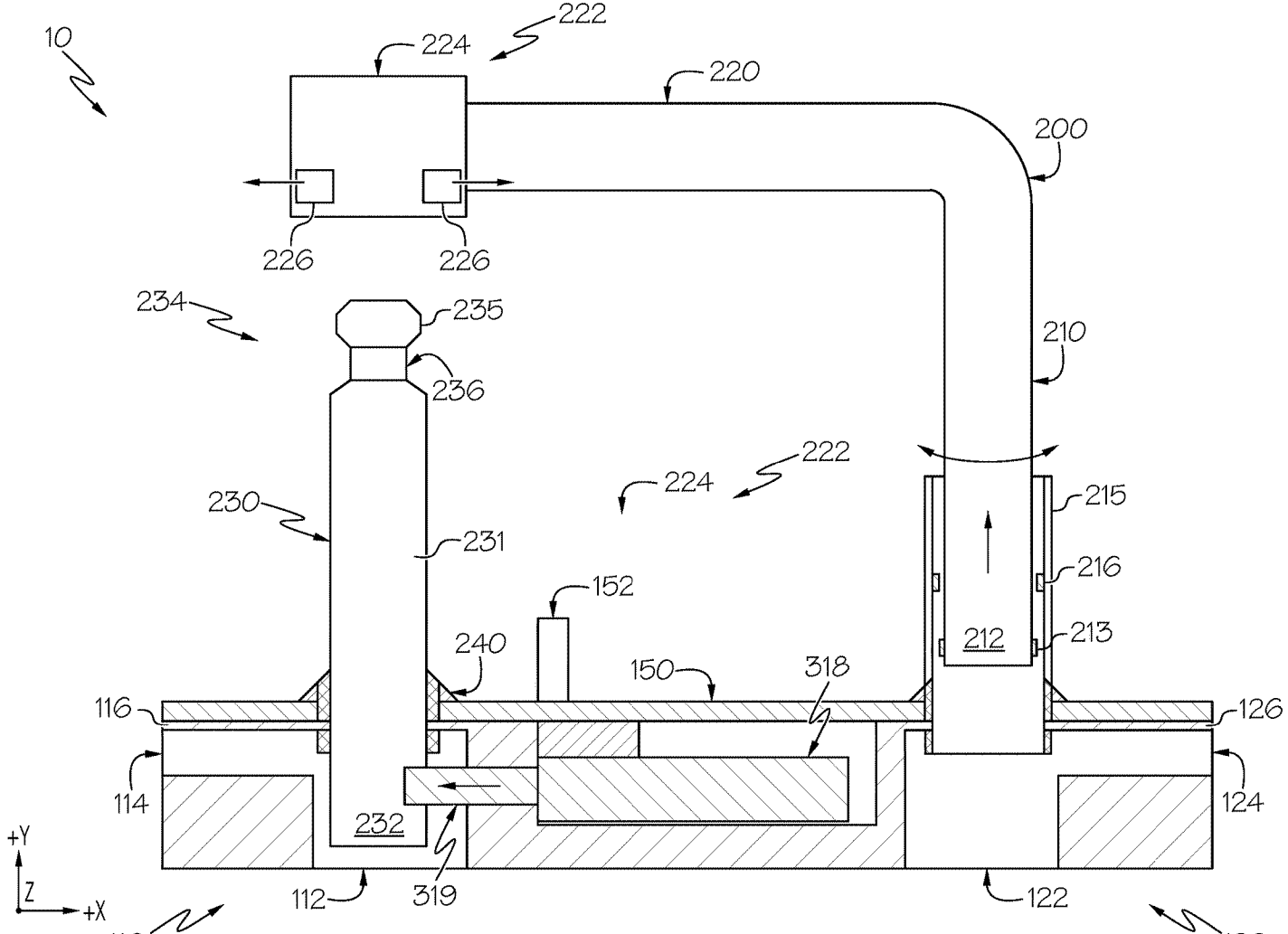
Figure 7:
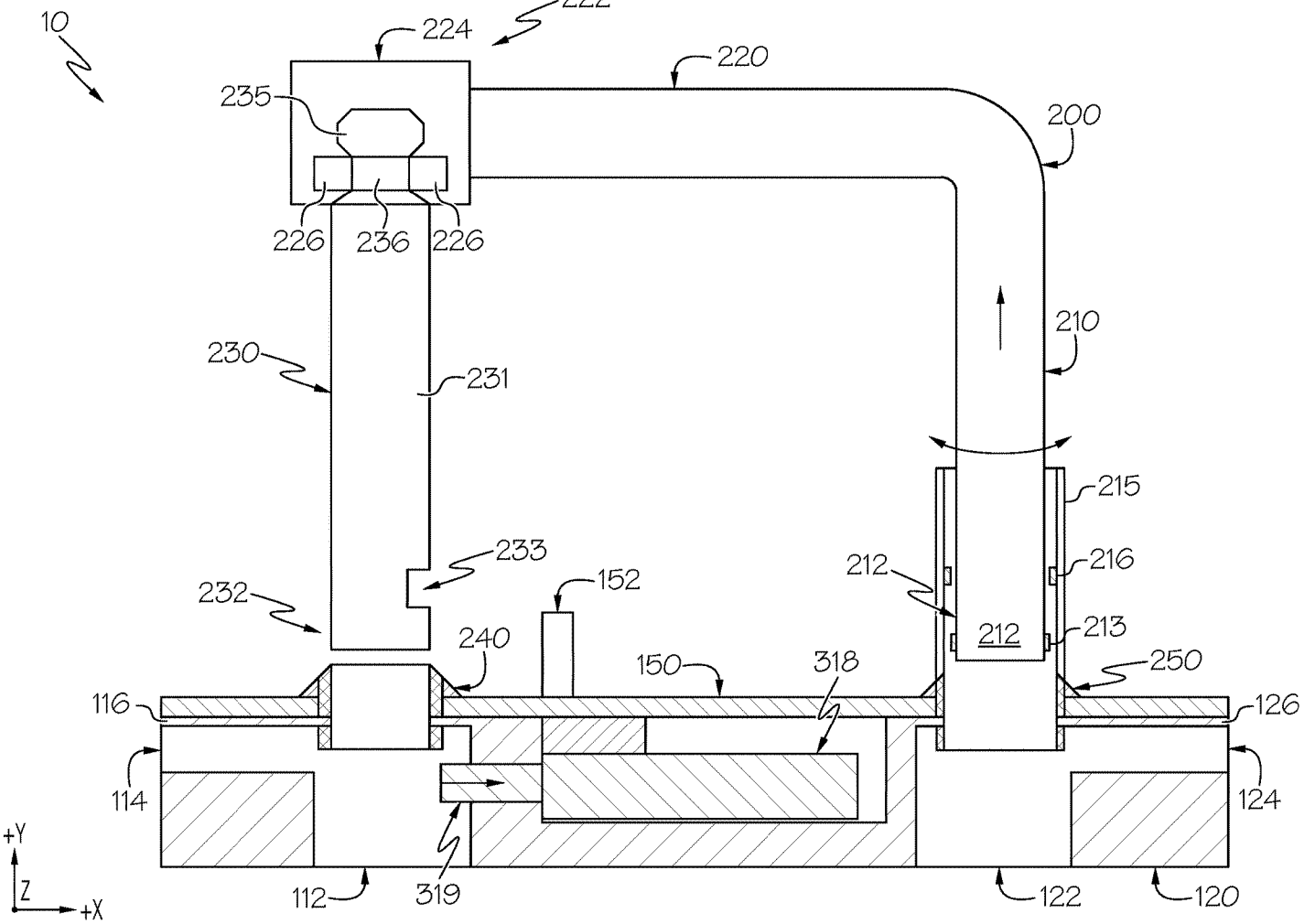
Figure 8:
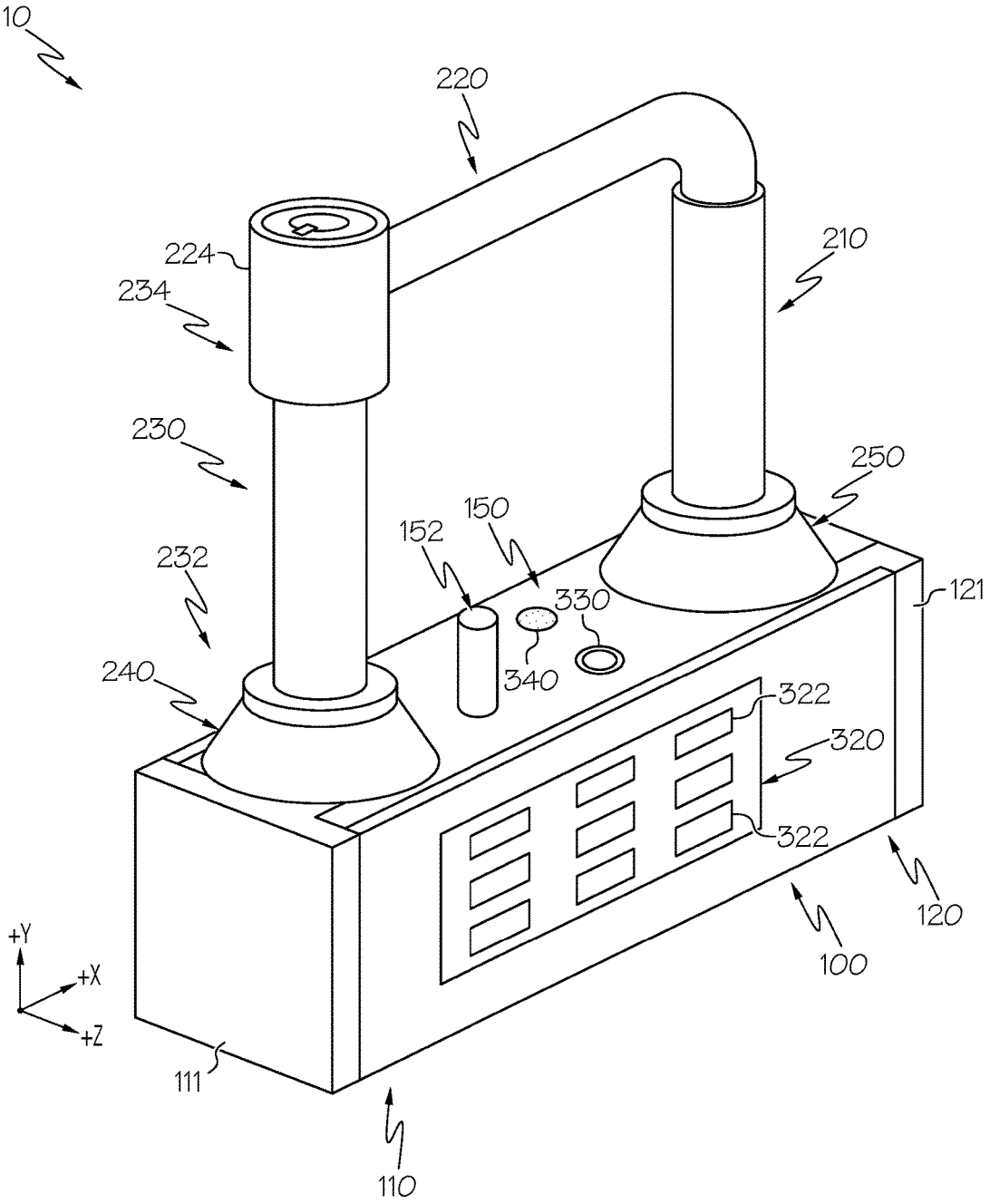
Figure 9:
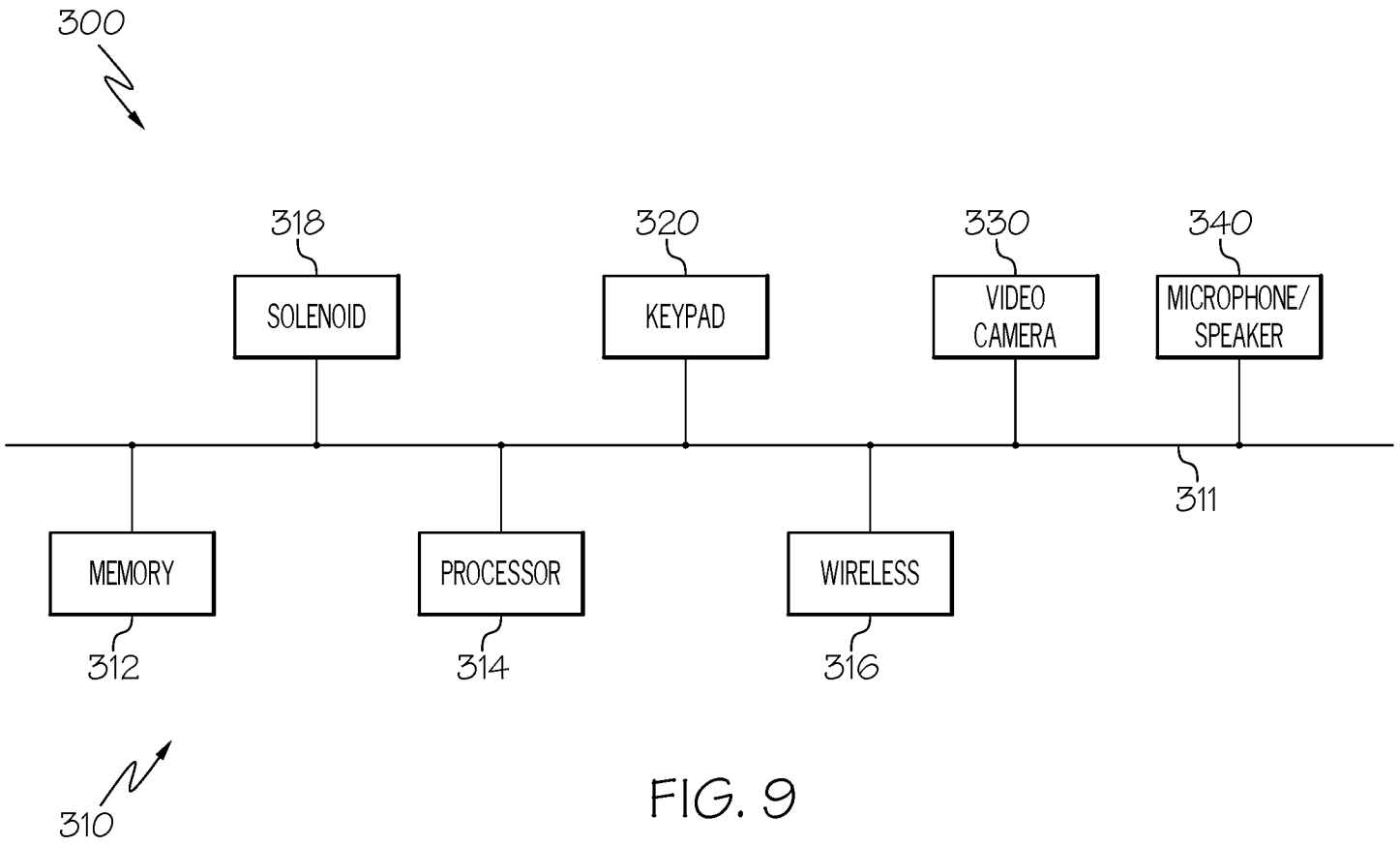
Figure 10:
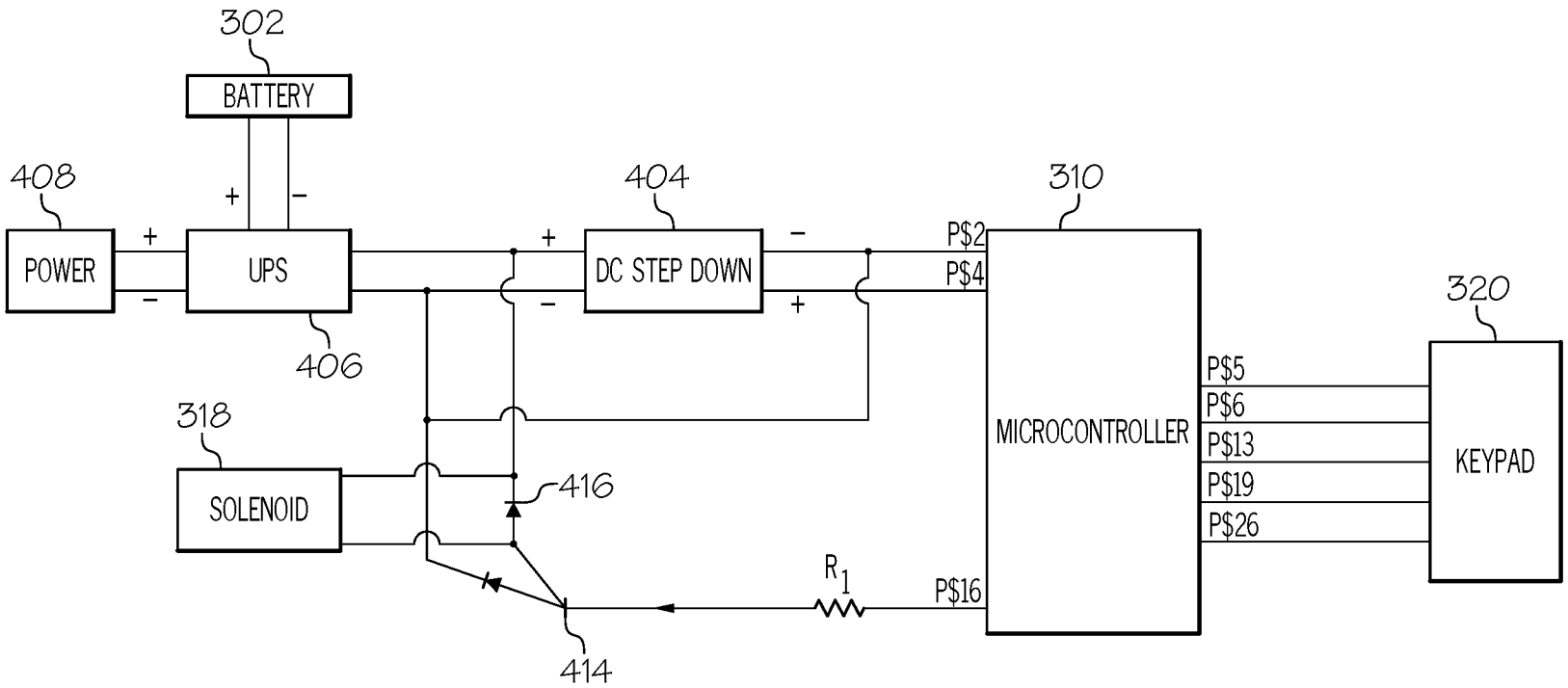

In order that the disclosure may be well understood, there will now be described various forms thereof, given by way of example, reference being made to the accompanying drawings, in which:

FIG. 1 schematically depicts a top view of an object in the form of a firearm secured to a quick release storage and locking system according to one or more embodiments disclosed and described herein;

FIG. 2 schematically depicts a perspective view of a quick release storage and locking system according to one or more embodiments disclosed and described herein;

FIG. 3 schematically depicts an exploded view of the quick release storage and locking system in FIG. 1;

FIG. 4A schematically depicts a top view of section 4A-4A in FIG. 2;

FIG. 4B schematically depicts an end view of section 4B-4B in FIG. 2;

FIG. 5 schematically depicts a side sectional view of a quick release storage and locking system in a lock position according to one or more embodiments disclosed and described herein;

FIG. 6 schematically depicts a side sectional view of a quick release storage and locking system in a first unlock position according to one or more embodiments disclosed and described herein;

FIG. 7 schematically depicts a side sectional view of a quick release storage and locking system in a first unlock position according to one or more embodiments disclosed and described herein;

FIG. 8 schematically depicts a perspective view of a quick release storage and locking system according to one or more embodiments disclosed and described herein;

FIG. 9 is a circuit diagram for an electric lock for a quick release storage and locking system in a first unlock position according to one or more embodiments disclosed and described herein; and FIG. 10 is a circuit diagram for an electric lock for a quick release storage and locking system in a first unlock position according to one or more embodiments disclosed and described herein.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

According to one or more embodiments described herein, a quick release storage and locking system may generally comprise a base with an electric lock, an L-shaped locking bar with a first end movably attached to the base and a second end with a manual lock, and a locking post with a first locking end and a second locking end spaced apart from the first locking end. In a "locked" configuration the electric lock is engaged with the first locking end of the locking post and the manual lock is engaged with the second locking end. As used herein the phrase "quick release" refers to unlocking and removing an object from the quick release and storage and locking system in less than five seconds unless otherwise noted. The term and phrase "locked" and "locked configuration" refer to at least two components securely attached to each other such that the two components cannot be physically separated from each other, and the term and phrase "unlocked" and "unlocked configuration" refer to at least two components not securely attached to other such that the two components can be physically separated from each other.

In a first unlocked configuration the electric lock is engaged with the first locking end of the locking post and the manual lock is disengaged with the second locking end. In a second unlocked configuration the electric lock is disengaged with the first locking end of the locking post and the manual lock is engaged with the second locking end. Accordingly, the quick release storage and locking system may be unlocked using the manual lock and/or electric lock. The quick release storage and locking systems described herein may be utilized to store and secure one or more firearms that may be quickly released using a key to unlock the locking post from the L-shaped locking bar and/or a wireless communication and/or electronic keypad to unlock the locking post from the base. The wireless communication may be provided from a personal electronic device (PED) such as a smart phone, computer, tablet, key fob, garage door opener, and the like. Various embodiments of cloaking devices with TC components and methods for using the same will be described in further detail herein with specific reference to the appended drawings.

FIG. 1 generally depicts one embodiment of a quick release storage and locking system 10. The quick release storage and locking system 10 includes a base 100, an L-shaped locking bar 200 with a manual lock 224, a locking post 230 and a trigger pin 152. The L-shaped locking bar 200, the locking post, and the trigger pin 152 secure and lock an object O with a trigger T and a trigger guard TG to the base 100 such that the object O cannot be removed from the base 100 and the trigger T cannot be moved such that the object O is activated.

Referring now to FIGS. 2-4B, a perspective view of the quick release storage and locking system 10 is schematically depicted in FIG. 2, an exploded view of the quick release storage and locking system 10 is schematically depicted in FIG. 3, a cross-sectional view of section 4A-4A in FIG. 2 is schematically depicted in FIG. 4A, and a cross-sectional view of section 4B-4B in FIG. 2 is schematically depicted in FIG. 4B. The quick release storage and locking system 10 comprises the base 100, the L-shaped locking bar 200 and a locking post 230. The base 100 includes a first end 110 and a second end 120 spaced apart from the first end 110. The first end 110 may include a first slot 114 (FIG. 2) comprising a flange 116 spaced apart and positioned above (+Y direction) a first slot base 118. The flange 116 may include an arcuate end 117 that is complementary in shape to a groove 246 of a first end socket 240. In some embodiments, the arcuate end 117 may be in the shape of a semi-circle. A first end aperture 112 may extend through the first slot base 118 to a lower surface 101 of the base 100 (FIGS. 3 and 5). The second end 120 may include a second slot 124 comprising a flange 126 spaced apart and positioned above (+Y direction) a second slot base 128. The flange 126 may include an arcuate end 127 that is complementary in shape to a groove 256 of a second end socket 250. In some embodiments, the arcuate end 127 may be in the shape of a semi-circle. A second end aperture 122 may extend through the second slot base 128 to the lower surface 101 of the base 100 (FIGS. 3 and 5).

Positioned between the first slot 114 and the second slot 124 may be an electric lock cavity 130. The electric lock cavity 130 may include a main chamber 132 within which a solenoid 140, a battery 144, and a microcontroller 146 may be disposed, and a solenoid chamber 134 extending from the main chamber 132 within which the solenoid 140 may be disposed. The solenoid 140 may include a locking pin 142 and the solenoid 140, battery 144 and microcontroller 146 may be in electrical communication with each other such that the locking pin 142 may be moved from a locked position (FIGS. 5 and 6) to an unlocked position (FIG. 7), and from the unlocked position (FIG. 7) to the locked position (FIGS. 5 and 6). A pair of anchor bolt apertures 138 may be included and extending through the base 100 from the lower surface 101 to the upper surface 103 (FIGS. 3 and 4A). In embodiments, anchor bolts (not shown) may be utilized to extend through the anchor bolt apertures 138 and rigidly attach the base 100 to a surface (not shown). A shoulder 139 may be included and positioned around and adjacent to each of the anchor bolt apertures 138. A pair of flanges 115 may be included and extend upwardly (+Y direction) from the upper surface 103 thereby providing a recess (not labeled) for a cover plate 150 to be positioned. The cover plate 150 comprises a first end 154 with a first slot 155 and a second end 156 with a second slot 157. In embodiments, the first slot 155 and the second slot 157 of the cover plate 150 are complimentary in shape with the first slot 114 and the second slot 124 of the base 100. The trigger pin 152 may extend upwardly (+Y direction) from the cover plate 150.

Referring now to FIGS. 2-5, the L-shaped locking bar 200 includes a first portion 210 with a first end 212 and a second portion 220 with a second end 222. The second portion 220 extends from the first portion 210 at a non-zero angle. In some embodiments, the second portion 220 extends from the first portion 210 at an angle between about 30° and about 120°. As schematically depicted in FIG. 2, the second portion 220 may extend from the first portion 210 at an angle of about 90°. The first end 212 may be disposed within the second end aperture 122 and/or the second slot 124 of the base 100 (FIG. 5) and the second end 222 may comprise a manual lock 224 with a manual lock latch 226. As used herein, the phrase "manual lock" refers to a lock that is activated, i.e., moved between a locked configuration to an unlocked configuration, using a physical key K. The first portion 210 may be disposed within a sleeve 215 and the second end socket 250 (FIGS. 2 and 5). The second end socket 250 may comprise an upper (+Y direction) portion 252 that is disposed above (+Y direction) the cover plate 150 and a lower portion (−Y direction) 254 disposed below (−Y direction) the cover plate 150 when the quick release storage and locking system 10 is assembled as depicted in FIGS. 2 and 5. The lower portion 254 of the second end socket 250 may include the groove 256 that is dimensioned for the lower portion 254 to slide and fit within the second slot 124 of the base 100. That is, the flange 126 has a thickness (Y direction) and the groove 256 has a width (Y direction) and a diameter such that the lower portion 254 of the second end socket 250 slidingly engages the flange 126 and the arcuate end 127. The sleeve 215 may include an inner rib 216 and the first end 212 of the L-shaped locking bar 200 may include an outer rib 213 such that the first portion 210 of the L-shaped locking bar 200 may slide within the sleeve 215 but is prevented from sliding out of the sleeve 215. That is, the inner rib 216 of the sleeve 215 engages the outer rib 213 of the first end 212 such that the first end 212 of the first portion 210 can slide up and down (+/−Y directions) within the sleeve 215 as indicated by the vertical double-headed arrow in FIG. 5, but cannot be removed from the sleeve 215. Also, the first portion 210 may rotate within the sleeve 215 and second end socket 250 as indicated by the generally horizontal double-headed arrow in FIG. 5.

Still referring to FIGS. 2-5, the locking post 230 includes a first locking end 232 and a second locking end 234. The first locking end 232 may include a locking pin recess 233 and the second locking end 234 may include a manual lock head 235 with a manual lock catch 236 (FIGS. 3 and 5). In a locked position (FIG. 5) the first end of the locking post 230 may be disposed within the first end socket 240 and the first end aperture 112. The first end socket 240 may comprise an upper (+Y direction) portion 242 that is disposed above (+Y direction) the cover plate 150 and a lower portion (−Y direction) 244 disposed below (−Y direction) the cover plate 150 when the quick release storage and locking system 10 is assembled as depicted in FIGS. 2 and 5. The lower portion 244 of the first end socket 240 may include the groove 246 that is dimensioned for the lower portion 244 to slide and fit within the first slot 114 of the base 100. That is, the flange 116 has a thickness (Y direction) and the groove 246 has a width (Y direction) and a diameter such that the lower portion 244 of the first end socket 240 slidingly engages the flange 116 and the arcuate end 117. The locking pin recess 233 may receive the locking pin 142 of the solenoid 140 such that the first locking end 232 of the locking post 230 is locked within the base 100. That is, positioning of the locking pin 142 of the solenoid 140 within the locking pin recess 233 of the locking post 230 as depicted in FIG. 5 prevents the first locking end 232 from being removed from the base 100 thereby locking the locking post 230 to the base 100. The manual lock catch 236 of the second locking end 234 may receive the manual lock latch 226 of the manual lock 224 such that the second locking end 234 of the locking post 230 is locked within the manual lock 224. That is, positioning of the manual lock latch 226 of the manual lock 224 within the manual lock catch 236 of the second locking end 234 prevents the second locking end 234 from being removed from the manual lock 224 thereby locking the locking post to the L-shaped locking bar 200.

Referring now to FIGS. 5-7, a side cross-sectional view of the quick release storage and locking system 10 is schematically depicted. Particularly, FIG. 5 depicts the quick release storage and locking system 10 in a locked position, FIG. 6 depicts the quick release storage and locking system 10 in a first unlocked position, and FIG. 7 depicts the quick release storage and locking system 10 in a second unlocked position. Referring specifically to FIG. 5 (locked position), the first end 212 of the L-shaped locking bar 200 is disposed within the second end aperture 122 of the base 100, the first locking end 232 of the locking post 230 is disposed within the first end aperture 112 and locked within the base 100 via the locking pin 142 disposed within the locking pin recess 233, and the second locking end 234 of the locking post 230 is locked within the manual lock 224 via the manual lock latch 226 engaged with the manual lock catch 236 of the second locking end 234. Accordingly, it should be understood that the object O (FIG. 1) secured to the base 100 by the L-shaped locking bar 200 and the locking post 230 cannot be removed from the base 100. Referring specifically to FIG. 6 (first unlocked position), the first end 212 of the L-shaped locking bar 200 is disposed within the sleeve 215 but not within the second end aperture 122 of the base 100, the first locking end 232 of the locking post 230 is disposed within the first end aperture 112 and locked within the base 100 via the locking pin 142 disposed within the locking pin recess 233, and the second locking end 234 of the locking post 230 is unlocked from the manual lock 224. Accordingly, it should be understood that the object O (FIG. 1) secured to the base 100 by the L-shaped locking bar 200 and the locking post 230 can be removed from the base 100 by sliding the trigger guard TG of the object O up (+Y direction) and over the second locking end 234 of the locking post 230. Referring specifically to FIG. 7 (second unlocked position), the first end 212 of the L-shaped locking bar 200 is disposed within the sleeve 215 but not within the second end aperture 122 of the base 100, the first locking end 232 of the locking post 230 is unlocked from the base 100, and the second locking end 234 of the locking post 230 is locked within the manual lock 224 via the manual lock latch 226 engaged with the manual lock catch 236 of the second locking end 234. Accordingly, it should be understood that the object O (FIG. 1) secured to the base 100 by the L-shaped locking bar 200 and the locking post 230 can be removed from the base 100 as the first locking end 232 slide up (+Y direction) and out of the trigger guard TG.

Referring now to FIG. 8, in embodiments the quick release storage and locking system 10 may include a keypad 320 with a plurality a keypad buttons 322. The keypad 320 may be positioned on the base 100 and programmed with a desired code (i.e., a combination of number, letters, etc.) and the plurality of keypad buttons 322 may be used to enter the desired code. Entering the desired code, i.e., pressing the plurality of keypad buttons 322 in a specific sequence, activates the solenoid 318 such that the locking pin 319 disengages the locking pin recess 233 and the quick release storage and locking system 10 may be placed in the second unlocked position (FIG. 7). Accordingly, in embodiments, the quick release storage and locking system 10 may be placed in the second unlocked position (FIG. 7) using wireless communication from PED and/or entering a desired code into the keypad 320.

Still referring to FIG. 8, in embodiments, the quick release storage and locking system 10 may include a video camera 330 and/or a microphone/speaker 340. The video camera 330 and/or microphone/speaker 340 may extend through the base plate and be in electrical communication with the microprocessor 310. In some embodiments, the video camera 330, when included, may be utilized to provide a video image of physical space surrounding the quick release storage and locking system 10 to a remote location. For example, the video camera 330 may be a motion activated video camera 330 that is activated when an individual approaches the quick release storage and locking system 10. Also, the activated video camera 330 may provide a video image of the individual to memory to be stored and/or to a remote location. As used herein, the phrase "remote location" refers to a location that is separate from and spaced apart some distance from the quick release storage and locking system 10. In other embodiments, the microphone/speaker 340, when included, may be utilized to provide an acoustic signal originating from the physical space surrounding the quick release storage and locking system 10 to a remote location. For example, the microphone/speaker 340 may be a microphone 340 that is activated when an individual talking, making noise, etc., approaches the quick release storage and locking system 10. Also, the activated microphone 340 transforms the acoustic signal to a corresponding electric signal (digital and/or analog) that may be stored in memory and/or transmitted to a remote location. In still other embodiments, the microphone/speaker 340, when included, may be utilized to provide an acoustic signal originating from a remote location to the physical space surrounding the quick release storage and locking system 10. For example, the microphone/speaker 340 may be a speaker 340 that provides a warning, instructions, etc., to an individual approaching the quick release storage and locking system 10 and detected by the video camera 330 and/or microphone/speaker 340. It should be understood that the video camera 330 and the microphone/speaker 340 may be utilized to provide: a video image of physical space surrounding the quick release storage and locking system 10 to a remote location; an acoustic signal (noise) originating from the physical space surrounding the quick release storage and locking system 10 to the remote location; and an acoustic signal originating from a remote location to the physical space surrounding the quick release storage and locking system 10.

Referring now to FIG. 9, embodiments of the electric lock 300, and optional keypad 320, video camera 330 and microphone/speaker 340, are schematically depicted. Particularly, the electric lock 300 may include the microprocessor 310 and the solenoid 318. In some embodiments, the keypad 320, the video camera 330 and/or the microphone/speaker 340 may be included. The microprocessor 310 may include a memory module 312 (also referred to herein simply as "memory"), a processor 314, and a wireless communication module 316. A communication path 311 interconnects the microprocessor 310, and the solenoid 318, and the keypad 320, video camera 330 and/or microphone/speaker 340 when included. The communication path 311 may be formed from any medium that is capable of transmitting a signal such as, for example, conductive wires, conductive traces, optical waveguides, or the like. Moreover, the communication path 311 may be formed from a combination of mediums capable of transmitting signals. In one embodiment, the communication path 311 comprises a combination of conductive traces, conductive wires, connectors, and buses that cooperate to permit the transmission of electrical data signals to components such as processors, memories, sensors, input devices, output devices, and communication devices. The term "signal" means a waveform (e.g., electrical, optical, magnetic, mechanical or electromagnetic), such as DC, AC, sinusoidal-wave, triangular-wave, square-wave, vibration, and the like, capable of traveling through a medium. The communication path 311 communicatively couples the various components of the electric lock 300. As used herein, the term "communicatively coupled" means that coupled components are capable of exchanging data signals with one another such as, for example, electrical signals via conductive medium, electromagnetic signals via air, optical signals via optical waveguides, and the like.

Still referring to FIG. 9, the processor 314 may be any device capable of executing machine readable instructions. Accordingly, the processor 314 may be a controller, an integrated circuit, a microchip, a computer, or any other computing device. The processor 314 is communicatively coupled to the other components of the electric lock 300, and the keypad 320, video camera 330, and microphone/speaker 340 when included, by the communication path 311. While the embodiment depicted in FIG. 9 includes only one processor 314, other embodiments may include multiple processors communicatively coupled with one another by the communication path 311.

The memory module 312 of the electric lock 300 is coupled to the communication path 311 and communicatively coupled to the processor 314. The memory module 312 may comprise RAM, ROM, flash memories, hard drives, or any device capable of storing machine readable instructions such that the machine readable instructions can be accessed and executed by the processor 314. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the memory module 312. Alternatively, the machine readable instructions may be written in a hardware description language (HDL), such as logic implemented via either a field-programmable gate array (FPGA) configuration or an application-specific integrated circuit (ASIC), or their equivalents. Accordingly, the functionality described herein may be implemented in any conventional computer programming language, as pre-programmed hardware elements, or as a combination of hardware and software components.

The wireless communication module 316 is coupled to the communication path 311 and communicatively coupled to the processor 314. The wireless communication module 316 may be any device capable of transmitting and/or receiving data via a network. Accordingly, the wireless communication module 316 may include a communication transceiver for sending and/or receiving any wired or wireless communication. For example, the wireless communication module 316 may include an antenna, a modem, LAN port, Wi-Fi card, WiMax card, mobile communications hardware, near-field communication hardware, satellite communication hardware and/or any wired or wireless hardware for communicating with other networks and/or devices. In one embodiment, the wireless communication module 316 includes hardware configured to operate in accordance with the Bluetooth® wireless communication protocol. In some embodiments, the wireless communication module 316 may be a wireless communication module configured to transmit and/or receive wireless signals according to the Bluetooth® 4.0 communication protocol. In such embodiments, the wireless communication module 316 may transmit and receive signals using less energy than other less energy efficient wireless communication protocols. However, in some embodiments the wireless communication module 316 is configured to transmit and/or receive wireless signals in accordance with a wireless communication protocol other than the Bluetooth® 4.0 communication protocol. Some embodiments may not include the wireless communication module 316, such as embodiments that include a wired communication module for transmitting and/or receiving data via a wired network. It should be appreciated that a user's electronic mobile device may pair via Wi-Fi, Bluetooth®, and/or the like to the wireless communication module 316 for the purpose of actuating the solenoid 318, as described in greater detail herein. Furthermore, a key fob may be used to remotely connect to the wireless communication module 316.

Still referring to FIG. 9, the solenoid 318 is coupled to the communication path 311 and communicatively coupled to the processor 314. The solenoid 318 is switched between states, actuations, positions, and/or the like based on an output signal from the processor 314. As such, the switching between states, actuations, positions, and/or the like may cause the solenoid 318, and particularly the locking pin 319 to engage or release the first locking end 232 of the locking post 230, as described above with reference to FIGS. 5-7.

In embodiments where the keypad 320 is included, the keypad 320 may be coupled to the communication path 311 and communicatively coupled to the processor 314. The keypad 320 outputs a keypad output signal when any key is depressed. In some embodiments, the keypad 320 is activated or deactivated in response to machine readable instructions executed by the processor 314.

In embodiments, where the video camera 330 is included, the video camera 330 may be coupled to the communication path 311 and communicatively coupled to the processor 314 and the wireless communication module 316. In some embodiments, the video camera 330 and the wireless communication module 316 may be utilized to transmit a video image of the physical space surrounding the quick release storage and locking system 10 to a remote location and/or store the video image in the memory module 312. Also, in embodiments where the microphone/speaker 340 is included, the microphone/speaker 340 may be coupled to the communication path 311 and communicatively coupled to the processor 314 and the wireless communication module 316 such that an acoustic signal originating from the physical space surrounding the quick release storage and locking system 10 may be transmitted to a remote location and/or stored in the memory module 312. In the alternative or in addition to, an acoustic signal originating from a remote location may be transmitted to the physical space surrounding the quick release storage and locking system 10.

Referring now to FIG. 10, in some embodiments, the processor 314, the memory module 312, and the wireless communication module 316 may be components of a microcontroller unit 402 (also referred to herein simply as a "microcontroller"). In such embodiments, the microcontroller 402 may be communicatively coupled to the solenoid 318, the keypad 320, and the wireless communication module 316 as schematically depicted in the circuit diagram shown in FIG. 9. An uninterruptible power supply 406 may be communicatively coupled to a step-down converter 404. In some embodiments, the uninterruptible power supply 406 may include a power supply 408 and a battery backup 410. It should be appreciated that the battery backup 410 is configured to take control and provide the uninterruptible power supply 406 with enough steady regulated power so to provide power without disruption of the operation of the solenoid 308. A load from the uninterruptible power supply 406, whether from the power supply 408, from the battery backup 410, or a combination of both, is directed into the step-down converter 404. The step-down converter 404 steps down the voltage from the input provided from the uninterruptible power supply 406 to its load transmitted to the microcontroller 402. As such, the stepped down load of the step-down converter 404 provides sufficient power to the microcontroller 402. The load may be coupled to input pin P$2 and P$4 of the microcontroller 402.

In embodiments where the keypad 320 is included, the keypad 320 may output keypad output signals to inputs P$5, P$6, P$13, P$19, and P$26 of the microcontroller 402 in response to touched inputs on the keypad 320. When executed by a processor of the microcontroller 402, machine readable instructions stored in the memory module of the microcontroller 402 cause the microcontroller 402 to determine whether the correct keyed sequence has been entered onto the keypad 320, as will be explained in further detail below.

An NPN transistor 414 (also referred to herein simply as "transistor") having a collector (not labeled), an emitter (not labeled), and a base (not labeled) is communicatively coupled to the microcontroller 402. A load resistor R1 is connected between the base of the transistor 414 and the pin P$16 of the microcontroller 402. The collector of the transistor 414 is in electrical communication with the solenoid 318. Two load lines connected to the collector of the transistor 414 are separated by a diode 416. The diode 416 is positioned between the two load lines such that at least one of the load lines from the collector of the transistor 414 may electrically power the solenoid 318 to generate the actuation. Moreover, the collector is coupled to the positive voltage load line of the uninterruptible power supply 406 prior to the step-down converter 404. On the other hand, the emitter is coupled to the negative voltage load line of the uninterruptible power supply 406 prior to the step-down converter 404. Further, the emitter is also coupled to the negative voltage load line of the step-down converter 404.

The transistor 414 may be configured to amplify a signal generated from P$16 such that, in response to the amplification, the solenoid 318 actuates to change states or positions. The signal generated by the microcontroller 402, through pin P$16, may be in response to request for the solenoid to actuate, or change states, such as a keypad input, a keyed input, a wireless command, and/or the like. When a request is received and executed by a processor of the microcontroller 402, machine readable instructions stored in the memory module of the microcontroller 402 cause the microcontroller to determine whether a valid request has been made based on the keypad output signals, a keyed signal, a wireless command, and/or the like.

It should be understood that additional resistors, capacitors, and other electronic components may be included and specific circuits used to interconnect the microcontroller 402, the solenoid 318, the solenoid 318, the video camera 330 and the microphone/speaker 340 may differ in other embodiments. Accordingly, embodiments are not limited to the specific components or circuit configurations depicted in FIG. 10. Moreover, the various resistors, capacitors, and other electronic components depicted in FIG. 10 may be arranged onto at least one printed circuit board ("PCB"). The PCB may be constructed of one or more sheet layers of copper laminated onto/between non-conductive substrate. Further, traces or circuit paths are etched into substrate so to form an electrical conductive path. It should be appreciated that the PCB does not need to be in this particular arrangement, and instead may be a flexible type, where the PCB is manufactured so to be able to have a single piece of PCB wrap around a structure. Moreover, it should be appreciated that circuit boards maybe used and that the circuit board need not be printed.

Referring back to FIGS. 1, 2 and 5-8, in operation, an article is secured and locked to the base 100 of the quick release storage and locking system 10. For example, the quick release storage and locking system 10 may be placed in the first unlocked position (FIG. 6) and/or the second unlocked position (FIG. 7) and the trigger guard TG of the object O positioned around the locking post 230 as depicted in FIG. 1. That is, with the quick release storage and locking system 10 in the first unlocked position (FIG. 6) the trigger guard TG may slide over the locking post 230. In the alternative, with the quick release storage and locking system 10 in the second unlocked position (FIG. 7) the locking post 230 may slide through the trigger guard TG. In embodiments where the trigger guard TG slides over the locking post 230 (FIG. 6), the manual lock 224 on the second end 22 of the L-shaped locking bar 200 may be moved downward (−Y direction) onto the second locking end 234 and the key K (FIG. 2) used to lock the second locking end 234 to the manual lock 224. Accordingly, the locking post 230 is secured to the base via the electric lock 300 and to the L-shaped locking bar 200 via the manual lock 224. It should be understood that the continuous loop formed by the base 100, L-shaped locking bar 200, and locking post 230 prevents the object from being removed from the quick release storage and locking system 10. Also, the trigger pin 152 prevents a trigger T of the object O from being moved into an actuation position.

In order to remove the object O from the quick release storage and locking system 10, a user of the object O may activate the solenoid 318 such that the locking pin 319 is withdrawn from the locking pin recess 233. With the locking pin 319 no longer engaged with the first locking end 232 of the locking post 230, the L-shaped locking bar 200 with the locking post 230 locked thereto may be moved upwardly (+Y direction) (FIG. 7) such that the locking post 230 slides out from within the trigger guard TG and the object O may be removed from the quick release storage and locking system 10. In embodiments, the solenoid 318 may be activated via a wireless signal by a PED. In other embodiments, the solenoid 318 may be activated via the keypad 320. Accordingly, a user may unlock the object from the quick release storage and locking system 10 without the use of the physical key K.

The user may also remove the object O from the quick release storage and locking system 10 by activating (unlocking) the manual lock 224 such that the manual lock latch 226 moves outwardly (+ and −X directions) and the second locking end 234 of the locking post 230 is unlocked from the manual lock 224 (FIG. 6). With the manual lock latch 226 disengaged from the manual lock catch 236 of the second locking end 234, the L-shaped locking bar 200 may be moved upwardly (+Y direction) (FIG. 7) such that the object O with the trigger guard TG may slide upwardly and be removed from the quick release storage and locking system 10.

Is should be understood that embodiments of the quick release storage and locking system disclosed herein provide secure storage and quick release of objects such as firearms, power tools, etc. The objects may be quickly (e.g., within about 1 to 3 seconds) released and removed from the quick release storage and locking system without the use of a physical key, for example using a wireless signal from a PED and/or using a keypad to activate an electric lock. Accordingly, embodiments of the quick release storage and locking system disclosed herein provide a system for secure storage of firearms, power tools, etc., while also providing for the quick release of such objects with at least two separate mechanisms, one of which does not require a physical key. Embodiments of the quick release storage and locking system disclosed herein also provide for the monitoring of the securely stored objects using video and/or sound detection systems. In response to detecting an individual in the vicinity of the quick release storage and locking system, an instruction, warning, etc., may be provided to the individual.

Directional terms as used herein—for example top, bottom, upper, and lower—are made only with reference to the figures as drawn and are not intended to imply absolute orientation unless otherwise expressly stated. Also, the term "about" as used herein means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A quick release storage and locking system comprising:

a base comprising an electric lock with a solenoid and a locking pin;

an L-shaped locking bar comprising a first end movably attached to the base and a second end comprising a manual lock;

a locking post comprising a first locking end and a second locking end spaced apart from the first locking end;

a locked position, a first unlocked position, and a second unlocked position different than the first unlocked position;

wherein the electric lock is configured to engage the first locking end such that the locking post is securely attached to the base and the manual lock is configured to engage the second locking end such that the L-shaped locking bar is securely attached to the locking post, the locking pin of the solenoid is engaged with the first locking end of the locking post in the locked position and the first unlocked position, and the locking pin of the solenoid is disengaged from the first locking end of the locking post in the second unlocked position.

2. The quick release storage and locking system of claim 1, wherein the electric lock is activated with a wireless communication.

3. The quick release storage and locking system of claim 1, wherein the electric lock is activated with a keypad.

4. The quick release storage and locking system of claim 1, wherein the manual lock is activated with a physical key.

5. The quick release storage and locking system of claim 1, wherein the electric lock is activated with a wireless communication and the manual lock is activated with a physical key.

6. The quick release storage and locking system of claim 1, wherein the electric lock is activated with a wireless communication and a keypad, and the manual lock is activated with a physical key.

7. The quick release storage and locking system of claim 1, wherein the electric lock comprises a microcontroller.

8. The quick release storage and locking system of claim 7, wherein:

the locked position comprises the locking pin of the electric lock engaged with the first locking end of the locking post and the manual lock engaged with the second locking end of the locking post;

the first unlocked position comprises the locking pin of the electric lock engaged with the first locking end of the locking post and the manual lock disengaged with the second locking end of the locking post; and the second unlocked position comprises the locking pin of the electric lock disengaged with the first locking end of the locking post and the manual lock engaged with the second locking end of the locking post.

9. The quick release storage and locking system of claim 1, wherein the base further comprises a keypad in electrical communication with the electric lock.

10. The quick release storage and locking system of claim 1, wherein the base comprises an electric lock cavity and the electric lock is at least partially disposed in the electric lock cavity.

11. The quick release storage and locking system of claim 10, further comprising a face plate extending over the electric lock cavity.

12. The quick release storage and locking system of claim 11, further comprising a trigger post attached to and extending from the face plate.

13. The quick release storage and locking system of claim 1, further comprising a video camera.

14. The quick release storage and locking system of claim 1, further comprising a microphone/speaker.

15. A method for storing, locking and quickly releasing a firearm, the method comprising:

positioning a firearm with a trigger and trigger guard on a quick release storage and locking system, the quick release storage and locking system comprising:

a base comprising an electric lock;

an L-shaped locking bar comprising a first end movably attached to the base and a second end comprising a manual lock; and a locking post comprising a first locking end and a second locking end spaced apart from the first locking end;

wherein the firearm is positioned and secured between the base and the L-shaped locking bar with the locking post extending through the trigger guard; and locking the firearm to the base by locking the first locking end of the locking post to the to the base via the electric lock and locking the second end of the locking post to the L-shaped locking bar via the manual lock.

16. The method of claim 15, further comprising unlocking the firearm from the base by disengaging the electric lock from the first locking end of the locking post.

17. The method of claim 16, wherein the electric lock is disengaged from the first locking end of the locking post via a wireless signal.

18. The method of claim 16, wherein the electric lock is disengaged from the first locking end of the locking post via a keypad signal.

* * * * *